US008496125B2

(12) United States Patent
Chen

(10) Patent No.: US 8,496,125 B2
(45) Date of Patent: Jul. 30, 2013

(54) CAP-SHAPED ITEMS HOLDER RACK

(76) Inventor: Fang-Yin Chen, Taichung (TW)

( * ) Notice: Subject to any disclaimer, the term of this patent is extended or adjusted under 35 U.S.C. 154(b) by 100 days.

(21) Appl. No.: 13/187,580

(22) Filed: Jul. 21, 2011

(65) Prior Publication Data

US 2013/0020269 A1 Jan. 24, 2013

(51) Int. Cl.
*A47F 7/00* (2006.01)

(52) U.S. Cl.
USPC ... 211/49.1; 211/59.2; 211/71.01; 211/85.18; 211/85.31

(58) Field of Classification Search
USPC ..... 211/49.1, 13.1, 14, 15, 59.2, 59.4, 211/71.01, 74, 85.18, 85.23, 85.26, 85.31; 248/311.2, 312, 312.1
See application file for complete search history.

(56) References Cited

U.S. PATENT DOCUMENTS

| | | | | | |
|---|---|---|---|---|---|
| 1,541,532 | A | * | 6/1925 | Simmons | 229/201 |
| 2,756,901 | A | * | 7/1956 | Cowsert | 221/132 |
| 3,152,697 | A | * | 10/1964 | Berman et al. | 211/59.2 |
| 3,265,246 | A | * | 8/1966 | Messenger | 221/283 |
| 3,777,933 | A | * | 12/1973 | Joliot | 221/309 |
| 3,843,071 | A | * | 10/1974 | Graham | 242/588.6 |
| 5,188,226 | A | * | 2/1993 | Platt | 206/429 |
| 6,095,584 | A | * | 8/2000 | Walsh et al. | 294/166 |
| 6,234,326 | B1 | * | 5/2001 | Higgins et al. | 211/74 |

* cited by examiner

*Primary Examiner* — Korie H Chan
(74) *Attorney, Agent, or Firm* — Muncy, Geissler, Olds & Lowe, PLLC

(57) ABSTRACT

A holder rack includes a supporting open frame, a rod baffle bonded to the supporting open frame in vertical, and a flat holder sheet member attached to the supporting open frame over the rod baffle for holding cap-shaped items vertically in a line. The flat holder sheet member has an upper opening, a lower opening, and an elongated slot connected between the upper opening and the lower opening and kept in proximity to the rod baffle.

3 Claims, 6 Drawing Sheets

CAP-SHAPED ITEMS HOLDER RACK

BACKGROUND OF THE INVENTION

1. Field of the Invention

The present invention relates to a holder rack for holding things and more particularly, to a holder rack for holding cap-shaped items.

2. Description of the Related Art

Boxes and plastic bags are commonly used for holding cap-shaped items (such as cap-shaped milk ball, cap-shaped coffee powder ball, etc.). However, storing cap-shaped items in a box or plastic bag cannot keep them in a good order. Further, when using one cap-shaped item, the user must open the box or plastic bag. It is inconvenient to serve cap-shaped items in this manner.

SUMMARY OF THE INVENTION

The present invention has been accomplished under the circumstances in view. It is one item of the present invention to provide a holder rack, which uses a flat holder sheet member for keeping cap-shaped items vertically in line(s). It is another item of the present invention to provide a holder rack, which facilitates storage and service of cap-shaped items and saves material consumption.

To achieve these and other objects of the present invention, a holder rack comprises a supporting open frame, a rod baffle bonded to the supporting open frame in vertical, and a flat holder sheet member attached to the supporting open frame over the rod baffle for holding cap-shaped items vertically in a line. The flat holder sheet member has an upper opening, a lower opening, and an elongated slot connected between the upper opening and the lower opening and kept in proximity to the rod baffle.

DETAILED DESCRIPTION OF THE PREFERRED EMBODIMENT

Figure 1:
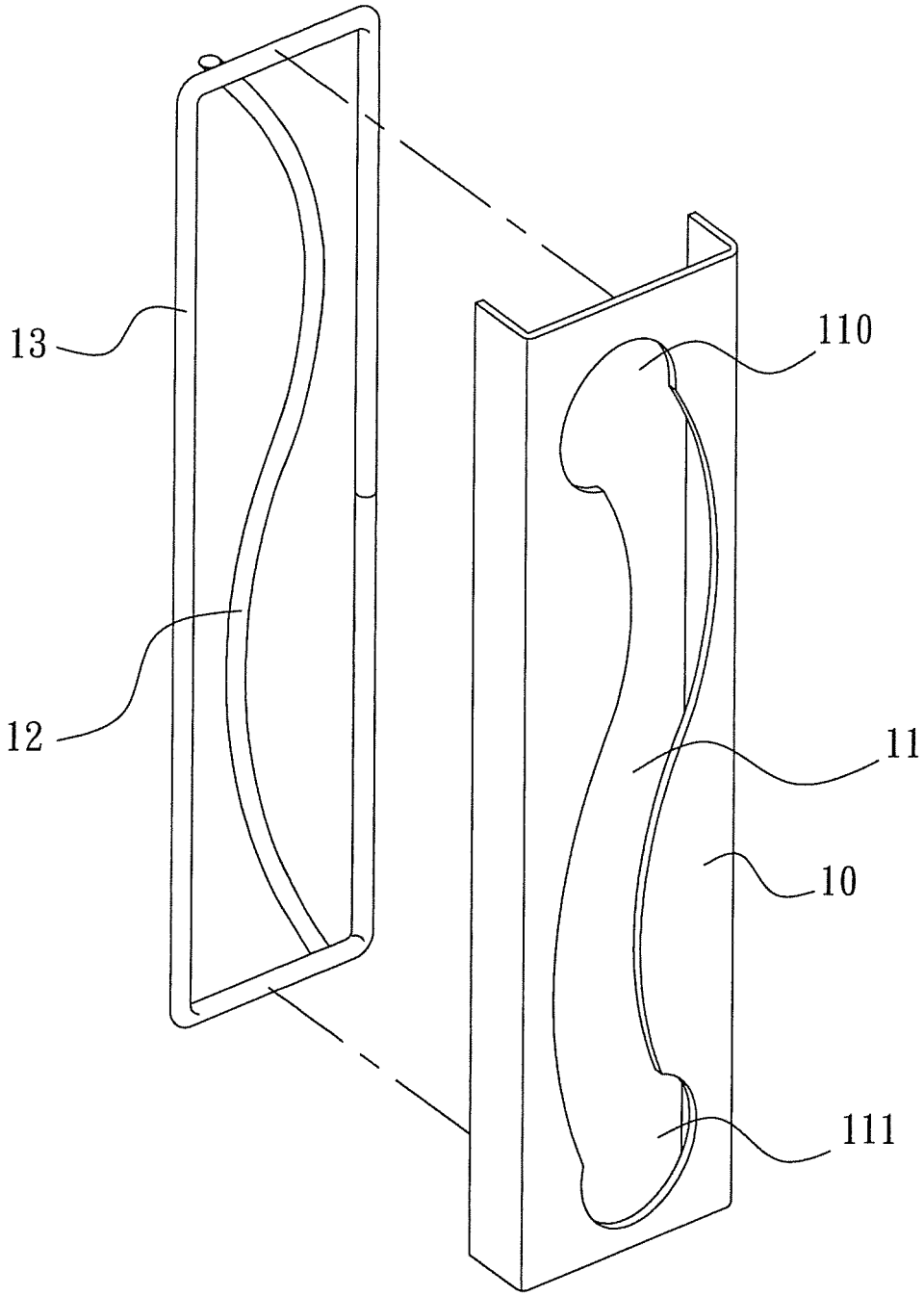
FIG. 1 is an exploded view of a holder rack in accordance with a first embodiment of the present invention.
Figure 2:
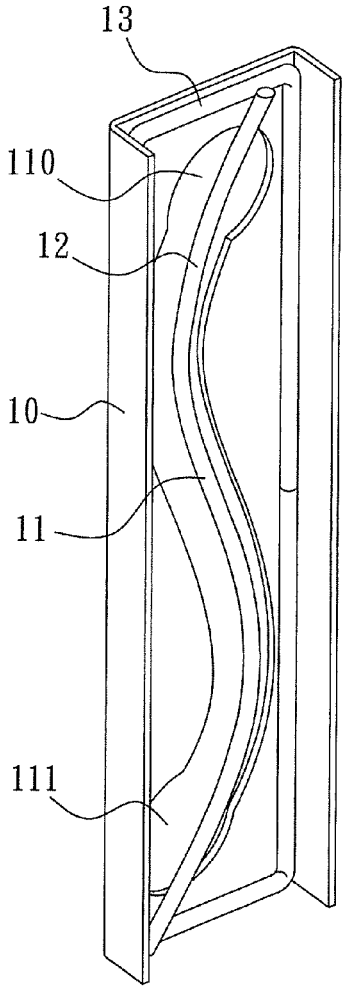
FIG. 2 is an oblique rear elevational view of the holder rack in accordance with the first embodiment of the present invention.
Figure 3:
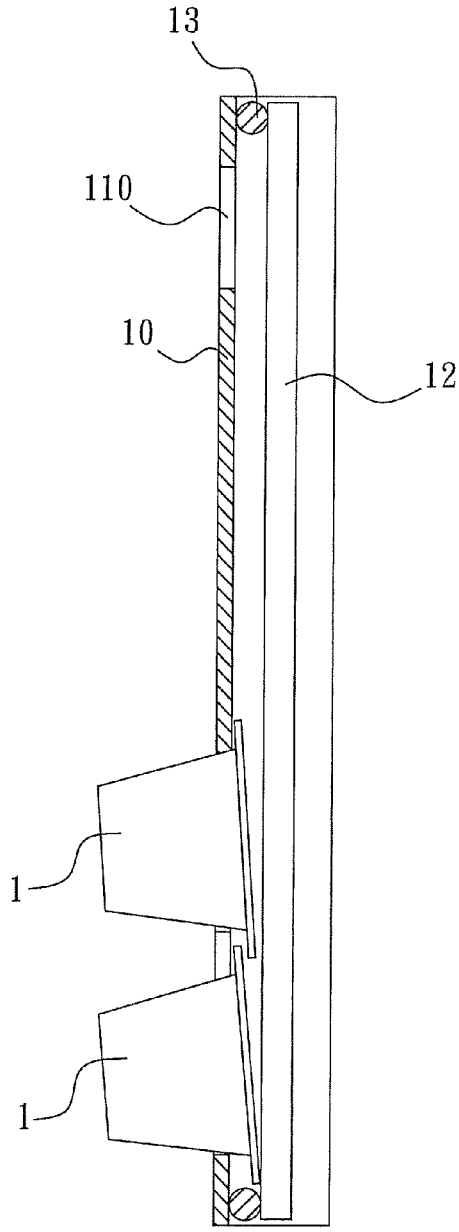
FIG. 3 is an applied view of the first embodiment of the present invention, illustrating cap-shaped items installed in the flat holder sheet member.

Referring to FIGS. 1~3, a holder rack in accordance with a first embodiment of the present invention is shown comprising a supporting open frame 13 made of wire rods and having a rod baffle 12 bonded thereto between top and bottom ends thereof, and a flat holder sheet member 10 attached to the supporting open frame 13 over the rod baffle 12 for holding cap-shaped items 1. The flat holder sheet member 10 has an upper opening 110, a lower opening 111 and an elongated slot 11 connected between the upper opening 110 and the lower opening 111. The elongated slot 11 has a width smaller than the diameter of the upper opening 110 and the diameter of the lower opening 111. The rod baffle 12 is configured subject to the combined configuration of the upper opening 110, the elongated slot 11 and the diameter of the lower opening 111.

During application, cap-shaped items 1 can be inserted through the upper opening 110 and lowered along the elongated slot 11 to have the rim of each inserted cap-shaped item 1 be retained in between the flat holder sheet member 10 and the rod baffle 12. Thus, multiple cap-shaped items 1 can be stored in the flat holder sheet member 10 in a stack. At this time, the rod baffle 12 stops the storage cap-shaped items 1 from falling out of the flat holder sheet member 10. When going to use the storage cap-shaped items 1, the user can pick up the lowest one at first and move it away from the elongated slot 11 through the lower opening 111.

Figure 4:
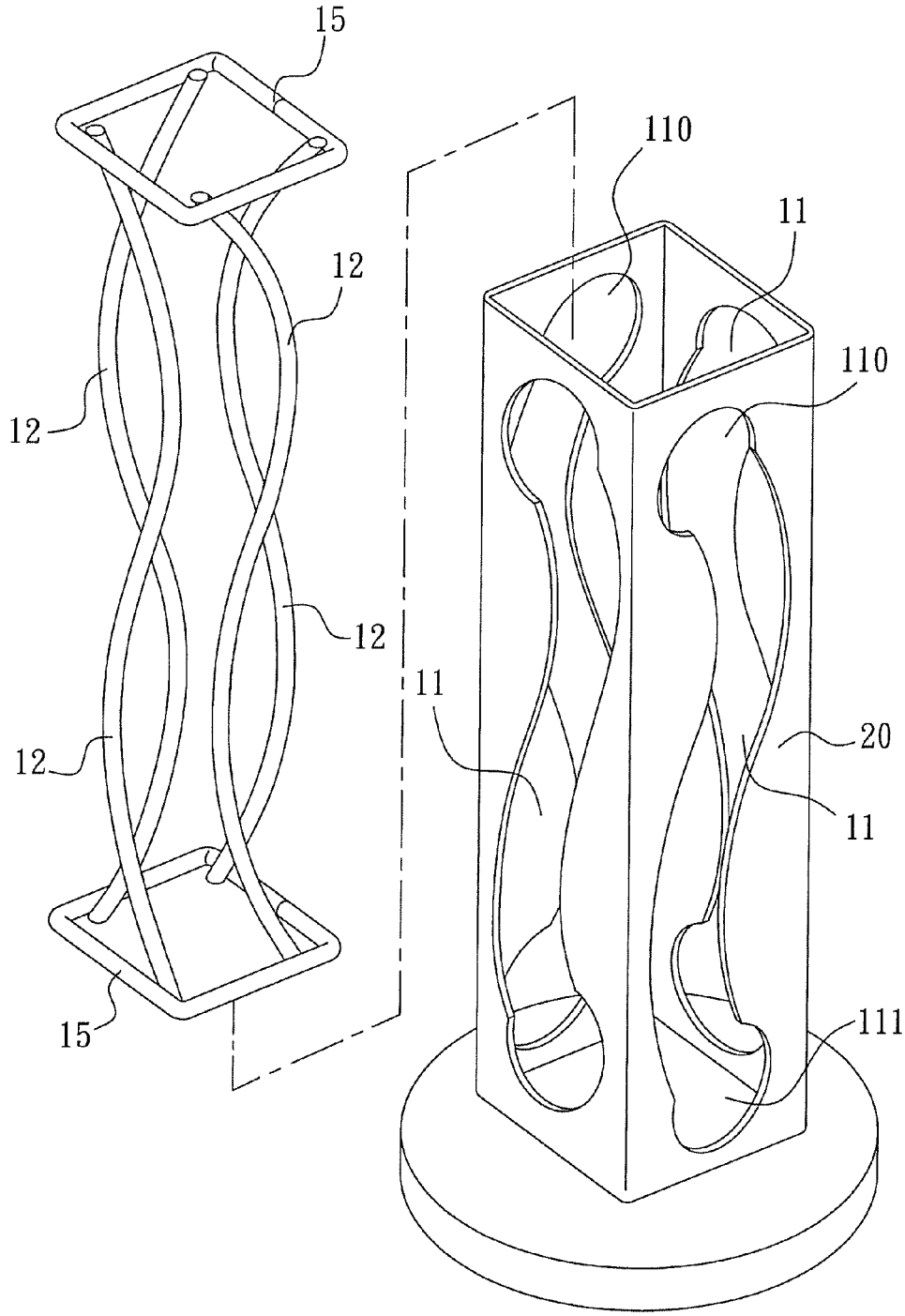
FIG. 4 is an exploded view of a holder rack in accordance with a second embodiment of the present invention.
Figure 5:
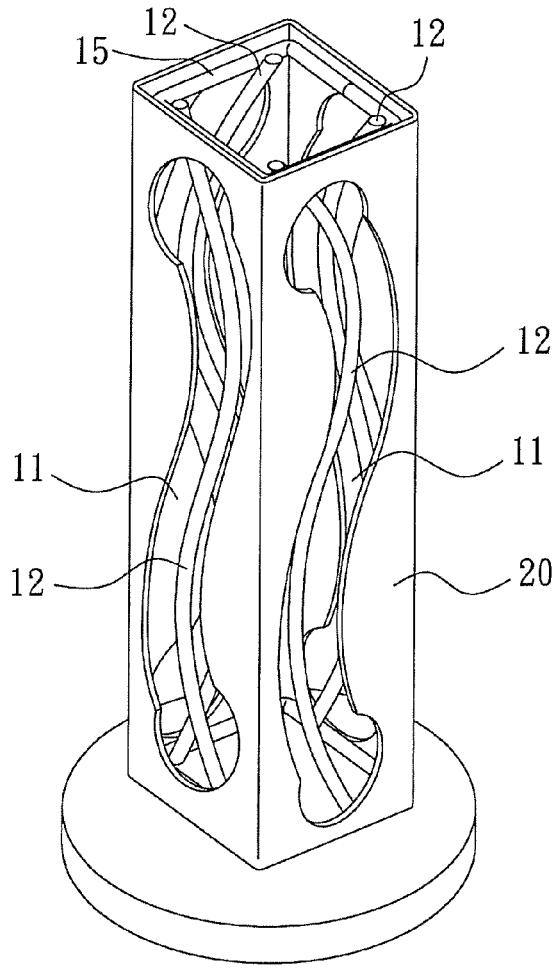
FIG. 5 is an oblique elevational assembly view of the holder rack in accordance with the second embodiment of the present invention.
Figure 6:
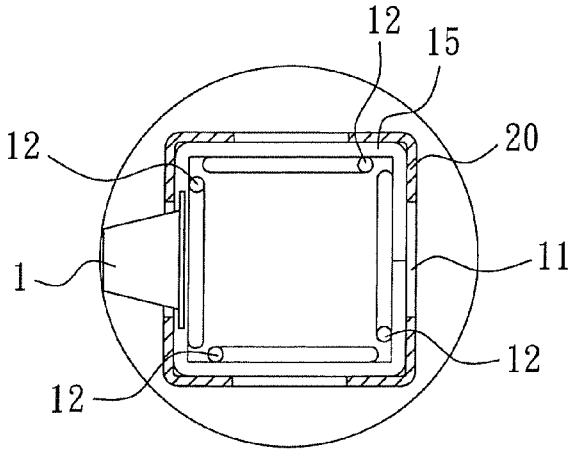
FIG. 6 is a top view of the second embodiment of the present invention, illustrating cap-shaped items installed in the flat holder sheet members.

FIGS. 4-6 illustrate a holder rack in accordance with a second embodiment of the present invention. According to this second embodiment, the holder rack comprises two rectangular open frames 15 arranged at different elevations in a parallel manner, 4 rod baffles 12 connected between the two rectangular open frames 15 at four sides, and a holder sheet member 20 made in the form of a rectangular tube and surrounding the rectangular open frames 15 and the rod baffle 12 for holding cap-shaped items 1. The holder sheet member 20 has an elongated slot 11 located on each of the four sides and connected between one respective upper opening and a respective lower opening (same as the aforesaid first embodiment). Thus, cap-shaped items 1 can be stored in the elongated slots 11 in the four sides of the holder sheet member 20.

Figure 7:
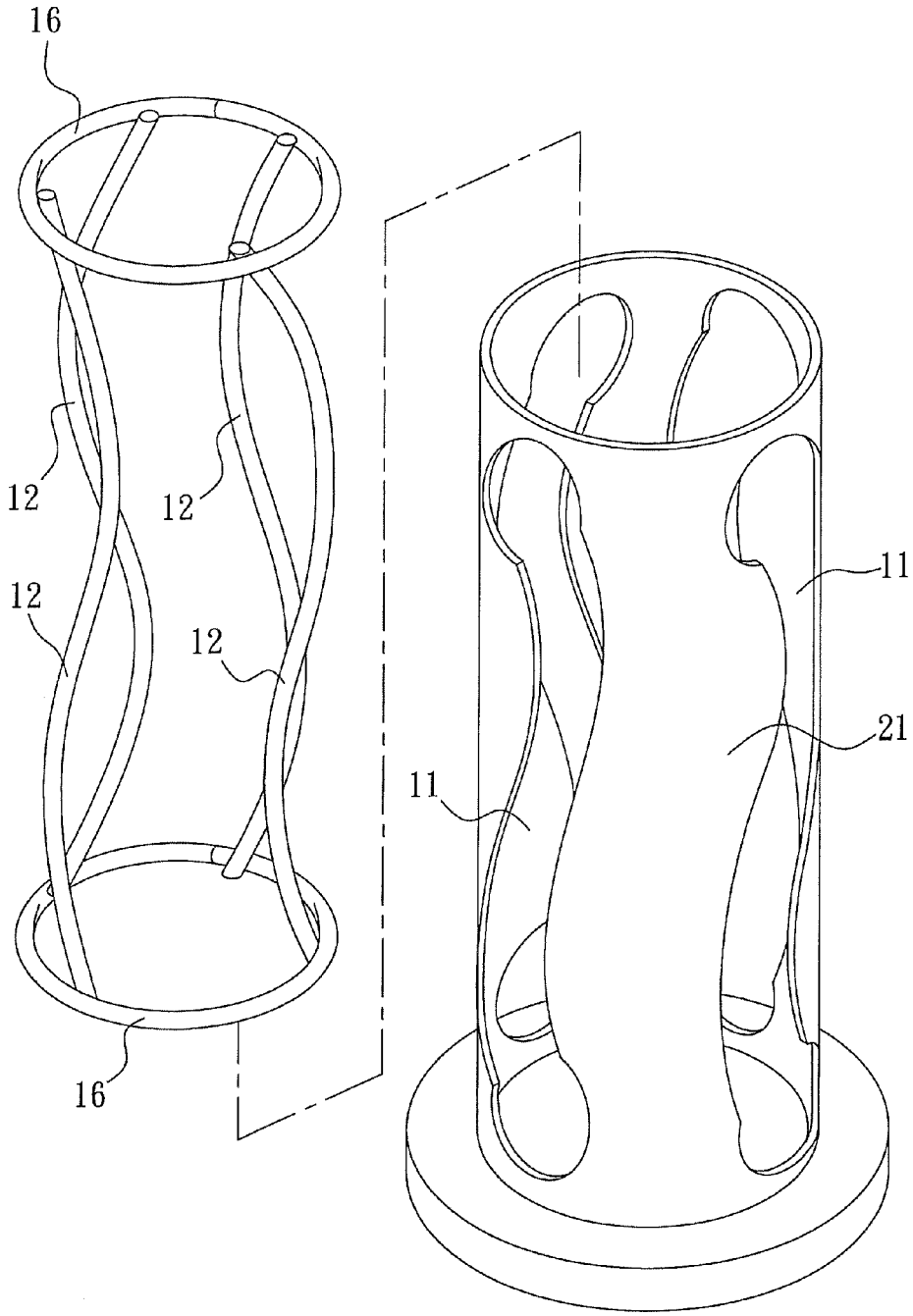
FIG. 7 is an exploded view of a holder rack in accordance with a third embodiment of the present invention.
Figure 8:
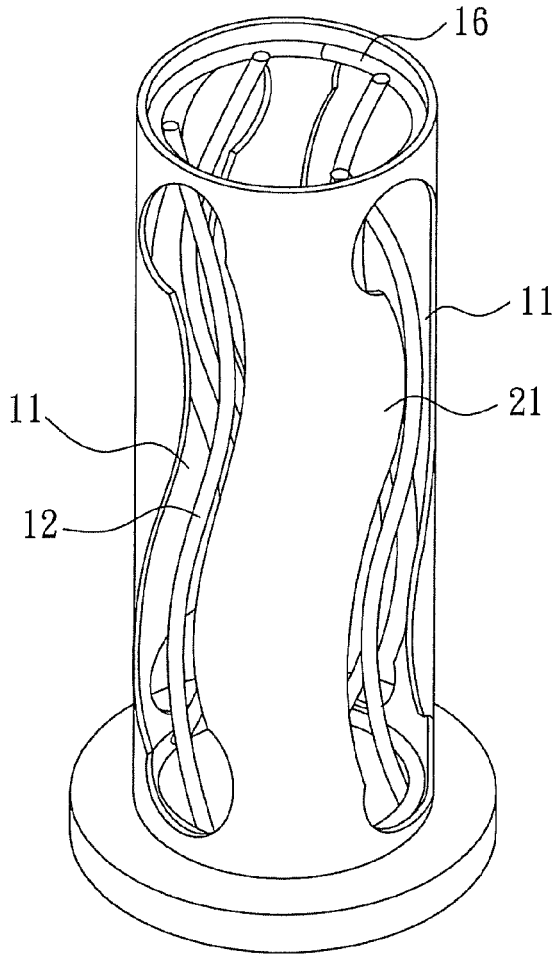
FIG. 8 is an oblique elevational assembly view of the holder rack in accordance with the third embodiment of the present invention.
Figure 9:
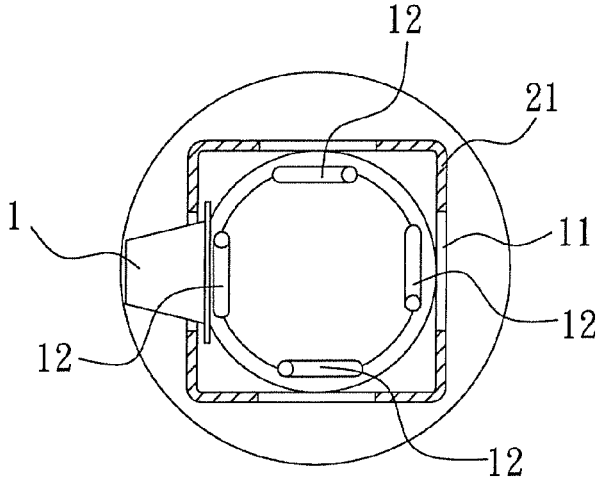
FIG. 9 is a top view of the second embodiment of the present invention, illustrating cap-shaped items installed in the circular holder sheet member.

FIGS. 7~9 illustrate a holder rack in accordance with a third embodiment of the present invention. According to this third embodiment, the holder rack comprises two circular open frames 16 arranged at different elevations, a plurality of rod baffles 12 connected between the two circular open frames 16 and equiangularly spaced from one another, and a holder sheet member 21 made in the form of a circular tube and surrounding the circular open frames 16 and the rod baffle 12 for holding cap-shaped items 1. The holder sheet member 21 has a plurality of elongated slots 11 respectively connected between respective upper openings and respective lower openings (similar to the aforesaid first and second embodiments). Thus, cap-shaped items 1 can be stored in the elongated slots 11 of the holder sheet member 21 in lines.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A holder rack, comprising a supporting open frame, at least one rod baffle bonded to said supporting open frame to extend vertically therealong, and a flat holder sheet member surrounding said supporting open frame over said at least one rod baffle for holding cap-shaped items, said flat holder sheet member comprising a panel portion having at least one upper opening and at least one lower opening symmetrically arranged at two different elevations and at least one elongated slot extending between said at least one upper opening and said at least one lower opening in substantial alignment with said at least one rod baffle.

2. The holder rack as claimed in claim 1, wherein said flat holder sheet member is arranged in the shape of a rectangular tube.

3. The holder rack as claimed in claim 1, wherein said flat holder sheet member is arranged in the shape of a circular tube.

* * * * *